United States Patent [19]

Miller

[11] Patent Number: 4,798,407

[45] Date of Patent: Jan. 17, 1989

[54] SLIDING GLASS DOOR LATCH BAR

[76] Inventor: Richard A. Miller, Box 253-1 Rte. 4, Fort Atkinson, Wis. 53538

[21] Appl. No.: 101,270

[22] Filed: Sep. 25, 1987

[51] Int. Cl.[4] ..... E05C 3/04

[52] U.S. Cl. ..... 292/229; 292/DIG. 46; 292/210

[58] Field of Search ..... 292/229, 262, 277, 338, 292/DIG. 15, DIG. 46, DIG. 61, 129, 173, 210

[56] References Cited

U.S. PATENT DOCUMENTS

| | | | |
|---|---|---|---|
| 318,323 | 5/1885 | Teetzel | 292/338 X |
| 807,401 | 12/1905 | Ross | 292/238 X |
| 1,481,501 | 1/1924 | Britten et al. | 292/338 |
| 1,583,650 | 5/1926 | Bobo | 292/338 |
| 1,967,592 | 7/1934 | Rawlings | 292/277 X |
| 3,250,558 | 5/1966 | McClintock | 292/DIG. 31 X |
| 3,917,331 | 11/1975 | Duran | 292/338 |
| 4,076,293 | 2/1978 | Valles | 292/338 |
| 4,407,539 | 10/1983 | Asp | 292/DIG. 46 X |
| 4,552,395 | 11/1985 | Dominguez | 297/229 X |
| 4,572,557 | 2/1986 | Taylor | 292/DIG. 46 X |
| 4,650,230 | 3/1987 | Takasaki | 292/173 |
| 4,652,030 | 3/1987 | Streett | 292/DIG. 61 X |

*Primary Examiner*—Richard E. Moore
*Attorney, Agent, or Firm*—Leon Gilden

[57] ABSTRACT

The latch bar of the type normally utilized in sliding glass or patio-type doors. Typically a sliding glass door is movably positioned in a channel and utilized in conjunction with a fixed glass panel. A pivoting latch member is provided that is normally spring biased in a retracted position and is manually repositioned and locked in a downward mode by means of a latch mechanism positioned proximate the pivoting end of the latch bar. When not in use, the latch bar may be secured in a vertically oriented posture by means of a clip element operably associated with an upstanding tab on said latch bar.

2 Claims, 1 Drawing Sheet

SLIDING GLASS DOOR LATCH BAR

BACKGROUND OF THE INVENTION

1. Field of the Invention

The present invention relates to latch bars and more particularly to a new and improved pivoting latch bar mechanism which may be stored in an operative vertical position and may thereafter be repositioned into operative position and thereby locked into place.

2. Description of the Priot Art

The use of latch bar mechanisms in cooperation with sliding glass-type doors is well known in the prior art. As may be appreciated, these devices at times have taken the form of a mere bar or rod positionable within a door channel to prevent opening of said sliding door. Such devices have normally been less then effective due to the need to constantly stoop down and take up the latch bar when its use is no longer necessary. Accordingly, these simple bars or rods are not utilized all of the time due to the awkwardness in their implementation rendering the door vulnerable for unwanted intrusions. Other mechanisms have been developed but have been relatively complex in manufacture and utilization and have not been accepted to the extent to make their presence effective. In this connection, there have been several attempts to develop sliding glass door latch mechanisms which may be easily and efficiently installed and retracted when not in use and positioned readily for use. For example, U.S. Pat. No. 4,135,376 to Evans illustrates a sliding glass door latch mechanism with a retractable clip requiring the latch bar to be manually positioned into and out of operative engagement with an associated latch in a sliding glass door. The latch bar in this instance is positioned medially of the fixed glass door and presents an obstruction of view through the fixed door and thereby limiting the purpose of a sliding glass door.

U.S. Pat. No. 4,248,461 to Stevens is a further example of a sliding glass door latch mechanism. It is positionable within the lower channel of a door mechanism and relies on a ratchet type of detent system for stopping the sliding glass doors traverse across its channel. The invention proves to be relatively cumbersome in that the locked latch bar must be continuously depressed into the nesting channel to enable normal opening of an associated door. The need for simplicity of operation and effectiveness is lacking in this patent as in other prior art references due to the cumbersome operation of the device and even when positioned in a separate parallel channel presents an unsightly adjunct not acceptable by many home owners.

U.S. Pat. No. 4,302,038 to Ervine is a further example of a latch bar positioned medially of a sliding glass door's framework thereby obstructing view of a stationary door and creating a relatively unsightly and undesirable adjunct in a normal patio-type door's utility. The device is essentially a pair of pivoted bars that are unlatched when positioned over center and are secured to create a rigid latch bar when positioned in an aligned orientation relative to one another.

U.S. Pat. No. 4,407,539 to Asp sets forth a biased latch bar that may normally bias a sliding glass door in a normally latched orientation by association of the latch bar in a normally detent position relative to the framework and the frictional inner-relationship of the latch bar and framework enables securement of the door thereby. Failure to provide a full channel latch bar by the Asp device presents a limited safety arrangement and furthermore the normal storage position of the bar when not in use at an elevated position relative to the sliding glass door presents a somewhat unsightly and unaesthetical arrangement.

U.S. Pat. No. 4,429,912 to Smith sets forth an overcenter latch bar that is positioned normally at the vertically remote portion of the sliding glass door frame and is relatively awkward to use due to its remote access and furthermore resists use as again providing an unsightly obstruction to normal viewing of a latch bar mechanism.

U.S. Pat. No. 4,437,694 to Lillo is positionable again presenting an obstruction in the use, enjoyment and purpose of sliding glass doors and whose retraction is based on a center of gravity principle relative to its pivot point that will not assure its inoperative positioning. Furthermore there is no positive securement of the latch bar in its operative mode. These deficiencies as in other prior art of the past as has been noted has resisted the application of the much needed security latch bar in contemporary sliding glass bar construction.

Canadian Pat. No. 537,681 to Weaver is merely another in a series of cumbersome latch bar mechanisms that has in the other instance failed to provide a means to effectively secure a sliding glass door again intrusion and provide ease of retraction storage when not in use.

As such, it may be appreciated that a continuing need exits or new and improved sliding glass door latch bar mechanisms which addresses both the problem of storage and effectiveness, and in this respect, the present invention substantially fulfills this need.

SUMMARY OF THE INVENTION

In view of the foregoing disadvantages inherent in the known types of latch bar mechanisms now present in the prior art, the present invention provides a sliding glass door latch bar that may be conveniently stored in an non-operative position when not in use and may be further readily and effectively repositioned and latched in a operative mode when desired. As such, the general purpose of the present invention, which will be described subsequently in greater detail, is to provide a new and improved sliding glass door latch bar mechanism which has all the advantages of the prior art sliding glass door latch mechanisms and none of the disadvantages.

To attain this, the present invention comprises a sliding glass door latch mechanism that is pivoted at a first end and is pivotable to a first position in a vertical orientation when not in use and secured against a vertical framework of a sliding glass door thereby. When use of the instant invention is deemed appropriate, the latch door mechanism is simply detached from its stored position in the inoperative mode and repositioned horizontally against the normal bias of a retraction spring and is thereafter positioned into a locked orientation to prevent undesired opening of a sliding glass door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claim be regarded as including such equivalent constructions insofar as they do not depart from the spirit and scope of the present invention.

It is therefore an object of the present invention to provide a new and improved sliding glass door latch bar which has all the advantages of the prior art sliding glass door latch bars and none of the disadvantages.

It is another object of the present invention to provide a new and improved sliding glass door latch bar which may be easily and efficiently manufactured and marketed.

It is a further object of the present invention to provide a new and improved sliding glass door latch bar which is of a durable and reliable construction.

An even further object of the present invention is to provide a new and improved sliding glass door latch bar which is susceptible of a low cost of manufacture with regard to both materials and labor, and which accordingly is then susceptible of low prices of sale to the consuming public, thereby making such sliding glass door latch bars economically available to the buying public.

Still yet another object of the present invention is to provide a new and improved sliding glass door latch bar which provides in the apparatuses and methods of the prior art some of the advantages thereof, which simultaneously overcoming some of the disadvantages normally associated therewith.

Still another object of the present invention is to provide a new and improved sliding glass door latch bar that is normally biased to enable easy grasping thereof and repositioning to an inoperative vertical orientation.

Even still another object of the present invention is to provide a new and improved sliding glass door latch mechanism that may be easily and readily manipulated to an operative position and thereafter locked into the thusly obtained orientation relative to a sliding glass door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
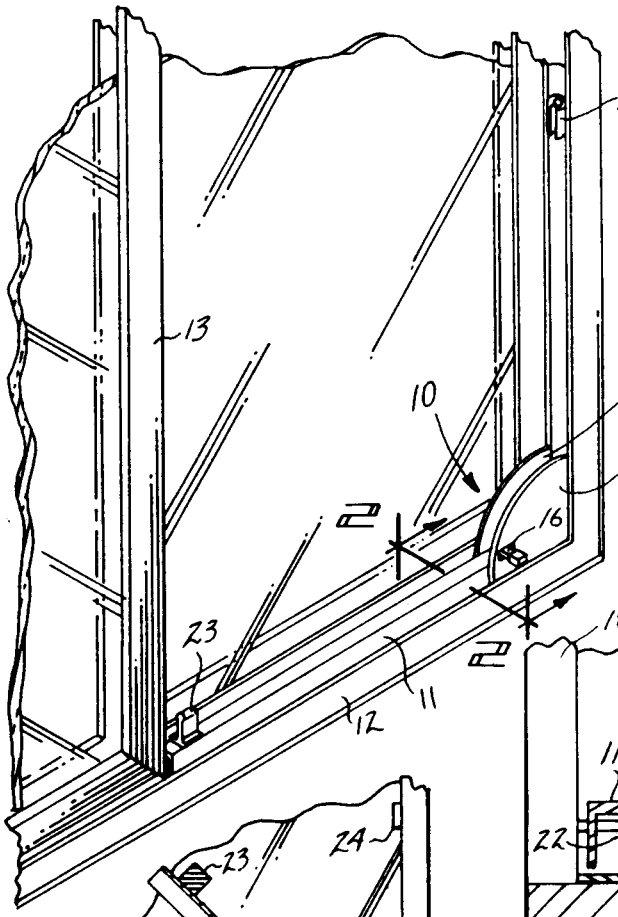
FIG. 1 is an isometric view of the present invention installed in a sliding glass door framework and illustrated in an operative mode.

With reference now to the drawings, and in particular to FIG. 1 thereof, a new and improved sliding door latch bar embodying the principles and concepts of the present invention and generally designated by the reference numeral 10 will be described.

Figure 2:
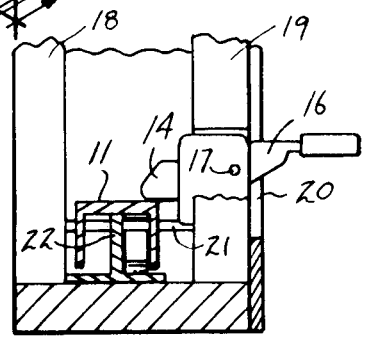
FIG. 2 is an orthographic side view of the present invention taken along the lines 2—2 of FIG. 1 in the direction indicated by the arrows.

More specifically, it will be noted that the latch bar mechanism 10 includes a latch bar 11 positioned in a lower horizontal door frame 12 in an operative mode relative to a sliding glass door 13. A pivotal detent nose portion 14 normally secures latch bar 11 in its operative position against the normal upward biasing force of a retraction spring 15. A latch lever 16 formed and pivoted at 17 withdraws detent nose 14 from the upper surface of latch bar 11 when it is desired to disengage latch bar 11 from sliding glass door 13. The securing mechanism including detent nose 14, latch lever 16, is positioned within an interior defined by inner and outer upstanding flange portions 18 and 19 and is of a well known type as typically formed in exterior aluminum storm doors. A slot 20 formed with an upstanding outer flange 19 permits the normal movement of latch 16. A pivot axle 21 positioned through inner and outer upstanding flanges 18 and 19 secure latch bar 11 in a pivotal manner relative to its working environment and pivot axle 21 along with the associated securement mechanism for latch bar 11 is relatively tamper proof within the confines of flange portions 18 and 19. Furthermore it should be noted that axle 21 is positioned in blind bores within inner upstanding flange 18 and similarly in upstanding flange 19 to prevent tampering of the axle 21 thereby. Further with attention to FIG. 2, at an upwardly depending stabilizing flange 22 positioned within upstanding flanges 18 and 19 add rigidity to the organization by rotating securement of pivotal axle 21 relative to said flange 22.

To secure said latch bar 11 in a removed orientation when not in use, a locking projection 23 is positioned at a forward portion of latch bar 11 and is engageable with a spring clip 24 secured within a vertical channel of the sliding glass door framework.

Figure 3:
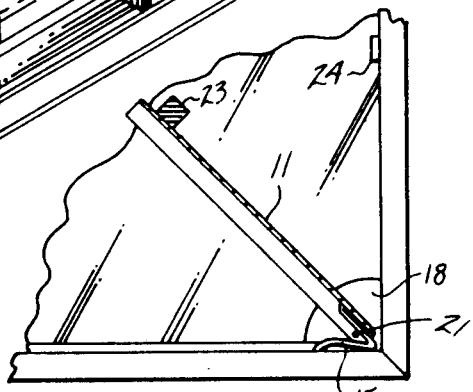
FIG. 3 is an orthographic side view of the present invention illustrating the latch bar mechanism biased in a released position enabling ready manipulation thereof.
Figure 4:
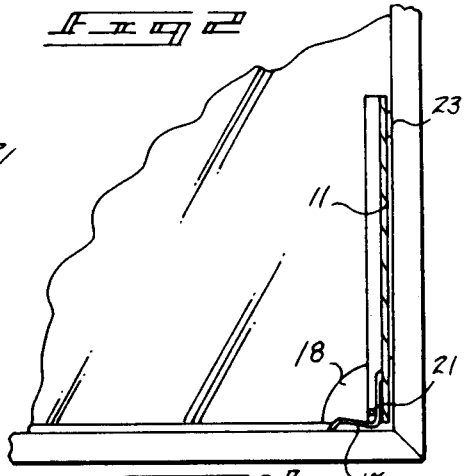
FIG. 4 is a side orthographic of the present invention illustrating the latch bar mechanism secured in a retractive position.

As to the manner of usage and operation of the present invention, the following description is presented. Latch bar 11 is normally positioned within lower horizontal door frame 12 by manually forcing latch bar 11 against the biasing force of retraction spring 15 whereupon it will engage with the underside of detent nose 14 and thereby maintain latch bar 11 in an operative position. When it is desired utilize the sliding glass door, the user merely steps upon latch lever 16 releasing latch bar 11 to a position generally as illustrated in FIG. 3 where ready grasping is thereby available to position latch bar 11 against the framework of the sliding glass door by positioning locking projection 23 within spring clip 24. In this manner, the visibility of the glass door is virtually unobstructed and the latch bar 11 is available for immediate use when desired.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A sliding glass door latch bar mechanism for use in combination with a sliding glass door and a stationary glass door relatively movable to one another within a perimeter framework wherein said latch bar mechanism comprises, a latch bar including a first and second end, and a pivotal means securing said first end within an upstanding framework, and a locking mechanism positioned within said framework proximate said first end, and a biasing means positioned between said framework and proximate said first end of said latch bar to bias said latch bar upwardly, wherein said latch bar is securable in a first horizontal position against the biasing force of said biasing means and secured and positioned by means of said locking mechanism, and said latch bar securable in a second vertical position by a second "U" shaped biasing means comprising spaced spring fingers for receiving said latch bar to define a "U" shape, and wherein said framework includes a pair of vertically positioned upstanding flanges positioned on either side of said latch bar, and wherein a locking projection of a lesser width than said latch bar is positioned proximate said second end of said latch bar to cooperate with said spring clip to secure said latch bar in a second vertical position, and said locking mechanism includes a pivotal latch lever means formed with a first pivoted end extending through and exteriorly of one of said flanges in a first position and extending interiorly of said flanges formed with a second end to selectively abut an upper surface of said latch bar in said first horizontal position, and said latch lever means operative to disengage said surface to release said latch bar upon pivoting said first pivotal end to a second position.

2. A latch bar mechanism as set forth in claim 1 wherein said latch bar is pivotally secured to said upstanding flanges by means of an axle positioned within blind bores of said upstanding flanges to pivotally capture said latch bar therebetween.

* * * * *